US005476334A

United States Patent [19]

Tello-Vallarino

[11] Patent Number: 5,476,334

[45] Date of Patent: Dec. 19, 1995

[54] FOLDABLE TOOTHBRUSH WITH TOOTHPASTE

[76] Inventor: Patricia Tello-Vallarino, APDO. 55-0343, Paitilla, Panama

[21] Appl. No.: 273,238

[22] Filed: Jul. 11, 1994

[51] Int. Cl.[6] ..... A46B 11/02

[52] U.S. Cl. ..... 401/268; 401/132; 401/269

[58] Field of Search ..... 401/268, 269, 401/132; 15/185

[56] References Cited

U.S. PATENT DOCUMENTS

| | | | |
|---|---|---|---|
| 1,084,923 | 1/1914 | Bowman | 401/268 X |
| 1,811,833 | 6/1931 | Simon | 401/268 X |
| 5,066,155 | 11/1991 | English et al. . | |

FOREIGN PATENT DOCUMENTS

| | | | |
|---|---|---|---|
| 2371178 | 7/1978 | France | 401/269 |
| 2550429 | 2/1985 | France | 401/132 |
| 2554331 | 5/1985 | France | 401/132 |
| 2579874 | 10/1986 | France | 401/132 |
| 2085717 | 5/1982 | United Kingdom | 401/268 |

*Primary Examiner*—Steven A. Bratlie
*Attorney, Agent, or Firm*—Welsh & Katz, Ltd.

[57] ABSTRACT

A foldable toothbrush having a self contained toothpaste applicator. The packet of toothpaste being contained within a cavity formed in a forward member. The cavity is beneath the bristles and a pair of passageways extend from the cavity to the bristles. A pair of fins extend outward from a rear member which is pivotally connected to the forward member. When the toothbrush is in the folded position, the fins extend within the passageways to block the flow of toothpaste from the packet through the passageways. When the toothbrush is unfolded, the blocking fins are removed from the passageways, and the toothpaste packet may then be pressed to force toothpaste from the packet through the passageways into the bristles.

16 Claims, 1 Drawing Sheet

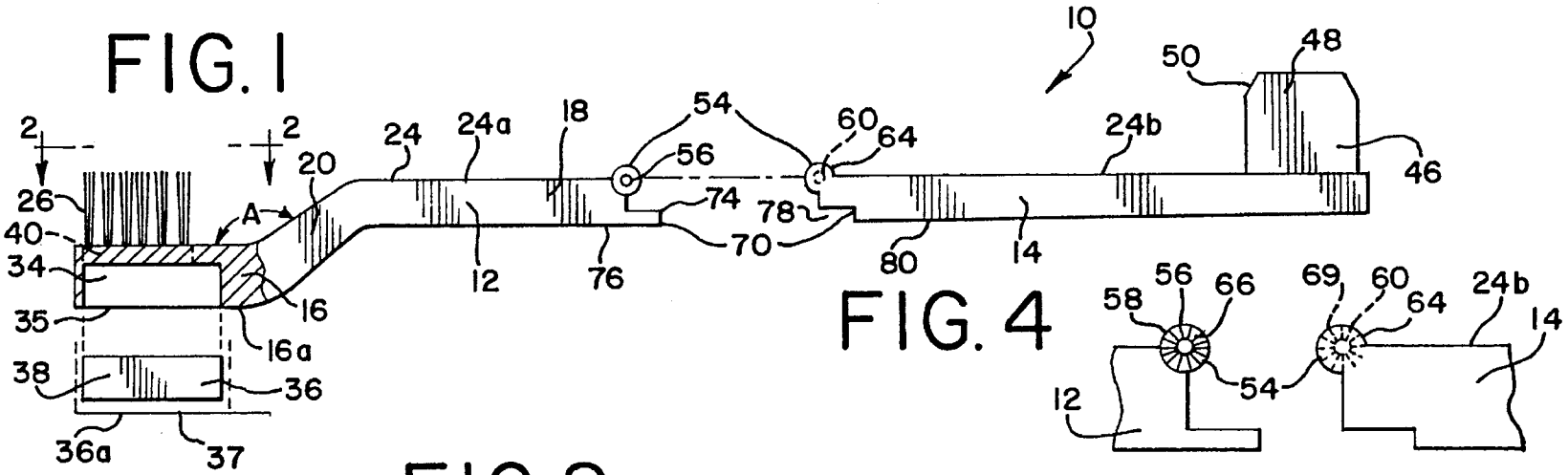
FIG. 1
FIG. 4
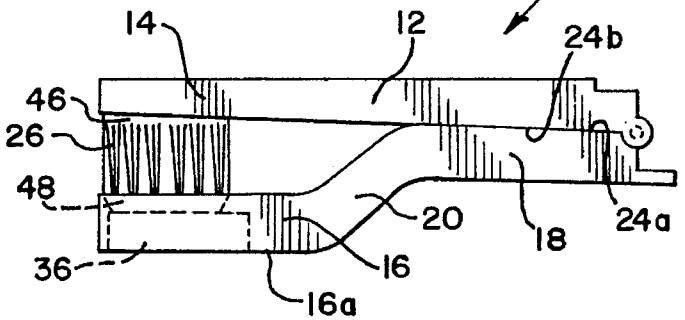
FIG. 3
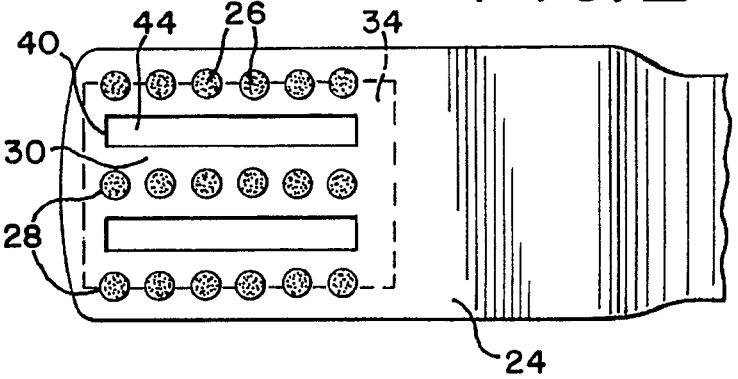
FIG. 2

FOLDABLE TOOTHBRUSH WITH TOOTHPASTE

FIELD OF THE INVENTION

The present invention relates to toothbrushes and more particularly to foldable toothbrushes having toothpaste applicators.

Brushing the teeth with a toothbrush is the principal means for practicing dental hygiene, and the use of toothpaste increases the effectiveness of the toothbrushes. The brushing of one's teeth normally takes place at one's residence, and brushing with toothpaste when away from the residence may present several difficulties.

One of the difficulties is that the configuration of the typical toothbrush does not lend itself to carrying in the pocket as the end of the toothbrush may protrude from the pocket. Also, once used, the toothbrush is typically moist which does not lend itself to carrying in the pocket or purse. In addition if a moistened toothbrush is stored in an enclosed area for an extended length of time, bacteria may grow on the toothbrush.

Another difficulty is that toothbrushes and toothpaste are typically separate items. In addition, the toothpaste is typically sold in containers having a quantity sufficient for multiple brushings. Therefore, the size of these toothpaste containers may cause the containers to be too bulky or heavy to be retained in the pocket or purse.

In addition, to prevent having to repack a toothbrush after use, the toothbrush and possibly the toothpaste dispenser may be discarded. This practice may be costly unless the toothbrush and toothpaste dispenser can be provided at low cost.

It is therefore an object of the present invention to provide an improved toothbrush and in particular a toothbrush having a toothpaste applicator.

A further object of the present invention is to provide an improved toothbrush which is configured to be easily carried in the pocket or purse.

Another object is to provide an improved toothbrush which is adapted to be disposed of after a single use. A related object is to provide such a toothbrush which may be constructed at low cost.

A still further object of the present invention is to provide an improved toothbrush in combination with a toothpaste applicator having a sufficient quantity of toothpaste for the intended use of the toothbrush. A related object is to provide such a toothbrush and applicator which may be easily used with a minimum of steps.

SUMMARY OF THE INVENTION

Accordingly the above objects are met or exceeded by a foldable toothbrush having a self contained toothpaste applicator. The toothbrush includes a pair of members which pivotally unfold from a folded position to an unfolded position. In the unfolded position, the pair of members define a forward member and rear member with a multitude of bristles extending upward from a forward section of the forward member.

The toothbrush also includes a toothpaste applicator having a packet of toothpaste which is housed in a downward opening cavity formed in the forward member beneath the bristles. A pair of passageways extend upward from the cavity through the upper member and form openings between adjacent rows of bristles. A pair of fins corresponding to the passageway openings, extend outward from the rear member, and when the toothbrush is in the folded position, the upper ends of the fins fit within the openings to block any flow of toothpaste through the passageways.

The toothbrush may be used by unfolding the toothbrush which removes the fins from the passageways. The toothpaste may then be compressed by pressing against a covering which sealingly covers the open lower end of the toothpaste retaining cavity thereby forcing toothpaste upward through the passageways and into the bristles.

BRIEF DESCRIPTION OF THE DRAWINGS

FIG. 1 is an exploded view of the preferred embodiment of the foldable toothbrush of the present invention in the unfolded position;

FIG. 2 is a partial plan view of a forward end section of the toothbrush of FIG. 1;

FIG. 3 is a side view of the toothbrush of FIG. 1 in the folded position; and FIG. 4 is an enlarged partial view of the toothbrush of FIG. 1 illustrating the hinge connection between the members forming the toothbrush.

DESCRIPTION OF THE PREFERRED EMBODIMENT

Referring to FIGS. 1–4 a preferred embodiment of a toothbrush according to the present invention is generally indicated at 10. The toothbrush 10 includes a forward member 12 which is pivotally connected to a rear member 14. The pivotal connection is adapted so that the forward member 12 may pivot from a closed or folded position as shown in FIG. 3 to an open or unfolded position as shown in FIG. 1.

The forward member 12 is configured with a forward section 16 which extends coparallel with, but offset to, a rear section 18. The forward section 16 and rear section 18 are attached by an angled intermediate section 20. The intermediate section 20 is angled from the forward section so that an obtuse angle A of approximately 147° is formed.

The forward and rear members 12, 14 are formed with similarly sized rectangular cross sectional peripheries and an upper preferably flattened face 24. A multitude of bristles 26 extend upward approximately 0.2 inches (5.5 mm) from the upper face 24 of the forward section 16. Referring to FIG. 2, the bristles 26 are arranged in three longitudinally extending groupings or rows 28. The groupings 28 are separated to form longitudinal extending spaces 30 between adjacent rows. The rows 28 of bristles 26 longitudinally extend for approximately 15/32 inches (12 mm) along the forward section 16 with the forward section having a length of approximately 10/16 inches (16 mm).

Referring back to FIG. 1, a downward opening cavity 34 is formed within the forward member 12 adjacent and below the bristles 26. The forward member 12 encloses the cavity 34 except for an opening 35 along the lower side of the cavity. The cavity 34 is preferably formed with a rectangular horizontal cross section.

The toothbrush 10 also includes a packet 36 disposed within the cavity 34 having a sufficient quantity of toothpaste 38 for a single brushing of the teeth. The packet 36 is preferably formed by covering the opening 35 with a film 37, preferably made of latex, so that a lower face **36*a* of the packet is flush with a lower face 16*a* of the forward section 16. The film 37 seals the toothpaste 38 within the cavity. The packet 36 may take other configurations such as being formed in a sack configuration with the toothpaste 38 in the packet and the closed base of the sack exposed at the opening 35 of the cavity 34**.

Referring also to FIG. 2, the forward section 16 of the forward member 12 forms at least one slot passageway 40 between the cavity 34 and the bristles 26. Preferably the forward section 16 forms two passageways 40 which extend from the upper face 24 of the forward section to an upper face 34*a* of the cavity 34. An upper opening 44 of the passageway 40 opens into the spaces 30 between the rows 28 of bristles 26.

The rear member 14 has an upward extending paste guard or fin 46 corresponding to each of the passageways 40. Referring also to FIG. 3, when the toothbrush 10 is in the closed position an upper portion 48 of each of the fins 46 is configured to fit through the opening 44 and into the upper portion of the corresponding passageway 40. By fitting within the passageway 40, the fin 46 forms a means for blocking a flow of toothpaste 38 from the cavity 34 through the passageway. The forward edge and rearward edge of the fin 46 may have forward and rear chamfers 50 to guide the upper portion 48 of the fin 46 into the passageway 40 during assembly of the toothbrush 10.

Referring to FIG. 4, a hinge 54 forms the pivotal connection between the rear member 14 and forward member 12. The hinge 54 is ratcheted to allow the toothbrush 10 to be folded from the folded position to the unfolded position but prevent the folding of the toothbrush from the folded position back into the unfolded position. In the preferred embodiment, the hinge 54 is formed with a laterally extending hinge pin 56 integrally formed with the forward member 12. Cylindrical end portions 58 of the hinge pin 56 fit within sockets 60 formed within a pair of lateral flanges 64 extending upward from the upper face 24*b* of the rear member 14. Ratchet teeth 66 are formed adjacent the end portions 58 of the pin 56, and corresponding ratchet teeth 69 are formed in the flanges 64 adjacent the sockets 60.

Referring back to FIG. 1, the hinge 54 also includes a lower stopping arrangement 70 to halt further pivoting of the rear member 14 relative to the forward member 12 when the rear member and rear section 19 of the forward member are aligned. The arrangement includes a planar extension 74 of a lower face 76 of the rear section 18 of the forward member 12. When the toothbrush 10 is unfolded from the folded position, the extension 74 is received within a similarly configured recess 78 formed in the forward end of the rear member 14 to prevent further pivoting. Also, when the extension 74 is received in the recess 78, the lower face 76 of the rear section 18 of the forward member is flush with the lower face 80 of the rear member to prevent any pinching of the gums on the toothbrush 10.

It is contemplated that the toothbrush 10 is provided in the folded position so that the upper face 24*a* of the forward member 12 is flush and contacting the upper face 24*b* of the rear member 14, and the toothbrush 10 is wrapped in a disposable wrapper (not shown). The cavity 34 contains a desired amount of toothpaste 38 and is covered with the film 37. However, the toothpaste 38 is blocked from flowing through the passageways 40 by the extension of the blocking fins 46 into the passageway.

When use is desired, the toothbrush 10 may be removed from the wrapper (not shown) and unfolded. As the toothbrush is unfolded, the fins 46 are removed from the passageways 40. The toothbrush 10 is unfolded until the forward member 12 is generally aligned with the rear member 14 and the extension 74 is received within the recess 78. In the unfolded position, the tooth brush has a length of approximately 4.33 inches (110 mm), with the intermediate section having a length of approximately ⅔ inches (16.5 mm).

The toothpaste 38 may then be forced out of the cavity 34 by pressing against the film 37. As the film 37 is pressed, toothpaste flows upward through the passageway 40 and flows out of the openings 44 (FIG. 3) and into the bristles 26. Placing the openings 44 in the spaces 30 between the rows 28 bristles acts to distribute the toothpaste evenly among the bristles. The toothbrush 10 is then ready for use. During brushing, the toothbrush is maintained in the unfolded position by the ratchet hinge 54. After use, the toothbrush 10 may be disposed of.

A specific embodiment of the novel foldable toothbrush with toothpaste according to the present invention has been described for the purposes of illustrating the manner in which the invention may be made and used. It should be understood that implementation of other variations and modifications of the invention in its various aspects will be apparent to those skilled the art, and that the invention is not limited by the specific embodiment described. It is therefore contemplated that the present invention covers any and all modifications, variations, or equivalents that fall within the true spirit and scope of the basic underlying principles disclosed and claimed herein.

What is claimed is:

1. A toothbrush comprising:

a forward member having a plurality of bristles disposed along an end portion of said forward member, said forward member forming a cavity in close proximity to said bristles;

a squeezable packet of toothpaste, housed within said cavity, said forward member forming a conduit from said cavity to said bristles to provide for the passage of toothpaste from said packet when said packet is squeezed;

a rear member pivotally connected to said forward member to pivot from a folded position to an unfolded position; and means attached to said rear member for substantially blocking the flow of toothpaste from said conduit into said bristles when said rear member is in said folded position.

2. The toothbrush of claim 1 further including a hinge means for pivotally connecting said rear member to said forward member, said hinge means including ratchet means to prevent the pivoting of said rear member from said unfolded position back into said folded position.

3. The toothbrush of claim 1 wherein said cavity is formed in said forward member below said bristles.

4. The toothbrush of claim 1 wherein said bristles are grouped to form a plurality of groupings, said groupings being separated from each other to form a spacing, said conduit opening into said spacing.

5. The toothbrush of claim 4 wherein said groupings form rows extending longitudinally along said forward member, said spacings extending longitudinally along said forward member.

6. The toothbrush of claim 1 wherein said rear member and said forward member form means for preventing further pivoting of said forward member relative to said rear member when said rear member and said forward member are pivoted into alignment.

7. The toothbrush of claim 1 wherein a lower face of said forward member forms an opening to said cavity, said packet including a film sealingly covering said opening.

8. The toothbrush of claim 1 wherein said packet includes a quantity of toothpaste within said cavity and means for retaining said toothpaste within said cavity.

9. The toothbrush of claim 1 wherein said blocking means includes a fin extending outward from said rear member, said fin being located along said rear member so that said fin fits within said conduit when said forward member and said rear member are in the folded position.

10. The toothbrush of claim 9 wherein an edge of said fin forms a chamfer.

11. A toothbrush comprising:

a forward member having a plurality of bristles disposed along an end portion of said forward member, said forward member forming a cavity in close proximity to said bristles;

a quantity of toothpaste within said cavity and means for retaining said toothpaste within said cavity, said forward member forming a conduit from said cavity to said bristles to provide for the passage of toothpaste from said retaining means when said retaining means is squeezed, said bristles being grouped to form a plurality of aligned rows, said rows being separated from an adjacent row to form a spacing, said conduit opening into said spacing;

a rear member pivotally connected to said forward member to pivot from a folded position to an unfolded position; and a fin extending outward from said rear member, said fin being located along said rear member so that said fin fits within said conduit to substantially block the flow of toothpaste from said conduit into said bristles when said rear member is in said folded position.

12. A toothbrush comprising:

a forward member having a plurality of bristles along an end portion of said forward member, said forward member forming a cavity opposite said bristles;

a packet having a quantity of toothpaste disposed in said cavity, said forward member forming a plurality of conduits from said cavity to said bristles to provide for the passage of toothpaste from said packet when said packet is squeezed;

a rear member pivotally connected to said forward member to pivot from a folded position to an unfolded position; and a plurality of fins corresponding to said conduits extending outward from said rear member so that a fin fits within each of said conduits to substantially block the flow of toothpaste from said conduits into said bristles when said rear member is in the folded position.

13. The toothbrush of claim 12 wherein said bristles are grouped to form a plurality of aligned rows separated by elongated spacings, an opening of each of said conduits being shaped in a form of a slot to extend along one of said spacings.

14. The toothbrush of claim 13 wherein said aligned rows and said spacings extend longitudinally along said forward member and said fins extending longitudinally along said rear member.

15. The toothbrush of claim 12 wherein said forward member forms an opening for said cavity, said packet including said toothpaste disposed in said cavity and a flat film extending across and covering said opening.

16. The toothbrush of claim 15 wherein the entirety of said toothpaste is disposed within said cavity.

* * * * *